US005165810A

United States Patent [19]

Bazzani

[11] Patent Number: 5,165,810

[45] Date of Patent: Nov. 24, 1992

[54] PORTABLE PRINTING APPARATUS

[75] Inventor: Giovanni Bazzani, Banchette di Iverea, Italy

[73] Assignee: Printax, S.R.L., Torino, Italy

[21] Appl. No.: 640,608

[22] Filed: Jan. 14, 1991

[30] Foreign Application Priority Data

Mar. 20, 1990 [IT] Italy ..... 19731 A/90

[51] Int. Cl.[5] ..... B41J 11/22

[52] U.S. Cl. ..... 400/354.3; 400/354; 400/621; 400/693; 400/656; 400/701; 101/479; 346/134

[58] Field of Search ..... 400/354, 354.3, 359, 400/357, 358, 691, 692, 693, 690.4, 88, 656, 680, 683, 719, 701; 101/479; 346/134, 146

[56] References Cited

U.S. PATENT DOCUMENTS

| | | | |
|---|---|---|---|
| 4,318,452 | 3/1982 | Reitner | 400/656 X |
| 4,445,100 | 6/1984 | Bauer | 400/88 |
| 4,531,852 | 7/1985 | Wadge | 400/692 |
| 4,806,036 | 2/1989 | Ward | 400/691 |
| 5,017,033 | 5/1991 | Hermann | 400/693 |

FOREIGN PATENT DOCUMENTS

| | | | |
|---|---|---|---|
| 3307899 | 10/1984 | Fed. Rep. of Germany | 400/357 |
| 77178 | 6/1981 | Japan | 400/88 |
| 61-8878 | 3/1986 | Japan | 400/354 |
| 49477 | 3/1988 | Japan | 400/691 |
| 199699 | 8/1988 | Japan | 400/692 |

OTHER PUBLICATIONS

IBM Technical Disclosure Bulletin, vol. 25, No. 5, Oct. 1982 "Supporting Rail Structure for Matrix Printhead".

*Primary Examiner*—Edgar S. Burr
*Assistant Examiner*—Eric P. Raciti
*Attorney, Agent, or Firm*—Laff, Whitesel, Conte & Saret

[57] ABSTRACT

The apparatus includes a bearing structure (2), a slidably movable print head (6) guided in said bearing structure, a dragging unit (22, 23) adapted to move a sheet (7) to be printed under the print head and exhibiting dragging members (22) directly acting on the sheet, a plate-like body (4) provided with a write surface (5) located under the print head and representing a rest surface for the sheet, the bearing surface being oscillatable relative to the plate-like body between an operating position in which the bearing surface and plate-like body are substantially in mutual contact and a raised position for putting the sheet in place, in which the dragging members directly acting on the sheet are located in the plate-like body substantially below the write surface.

7 Claims, 3 Drawing Sheets

PORTABLE PRINTING APPARATUS

FIELD AND BACKGROUND OF THE INVENTION

The present invention relates to a portable printing apparatus.

It is known that nowadays it is increasingly necessary to have practical and handy portable data processing apparatus to be used in any circumstance, for example in order to print invoices, standardized forms or documents directly at the place they are required. Printers of the portable type have been produced which substantially comprise a bearing structure, a print head slidably movable in the bearing structure and a dragging unit exhibiting dragging members adapted to move a sheet to be printed under the print head.

Known portable printing apparatus have however many limits and drawbacks.

In fact they achieve the main intended aim of easy transportability, only to a limited extent because the sizes and weight of the bearing structure they are provided with are not sufficiently reduced.

In addition the print accuracy does not always reach a completely acceptable level and, when this level is obtained, the apparatus weight is greatly affected.

It is also to be pointed out that the print quality, above all as far as copies underneath the main sheet are concerned, is many times poor and the print operation itself is not always noiseless enough.

SUMMARY OF THE INVENTION

Under this situation, the technical task underlying the present invention is to devise a portable printing apparatus capable of substantially eliminating the above drawbacks.

Within the scope of this technical task it is an important object of the invention to devise a printing apparatus enabling to combine a high print accuracy and quality even in the copies with a greatly reduced bulkiness and weight.

A further object of the invention is to provide an embodiment of the invention which is advantageous in itself while representing a technical improvement in the specific field.

The above specified technical task and objects and still further objects that will become more apparent in the following description are substantially achieved by a portable printing apparatus comprising: a bearing structure: a print head slidably movable and guided within said bearing structure: a dragging unit adapted to move a sheet to be printed under said print head and exhibiting dragging members directly acting on said sheet, wherein the portable printing apparatus further comprises: a plate-like body in which a write surface located underneath said print head and adapted to rest on said sheet to be printed is provided: hinge means for oscillatably connecting the bearing structure to the plate-like body according to a substantially horizontal axis, from an operating position in which they are in mutual contact to a raised position for the positioning of said sheet, said dragging members directly acting on said sheet being disposed in said plate-like body substantially below said write surface.

BRIEF DESCRIPTION OF THE DRAWINGS

The following description of some preferred embodiments of a portable printing apparatus in accordance with the invention is given hereinafter by way of non-limiting example with reference to the accompanying drawings, in which.

DESCRIPTION OF THE PREFERRED EMBODIMENT

Figure 1:
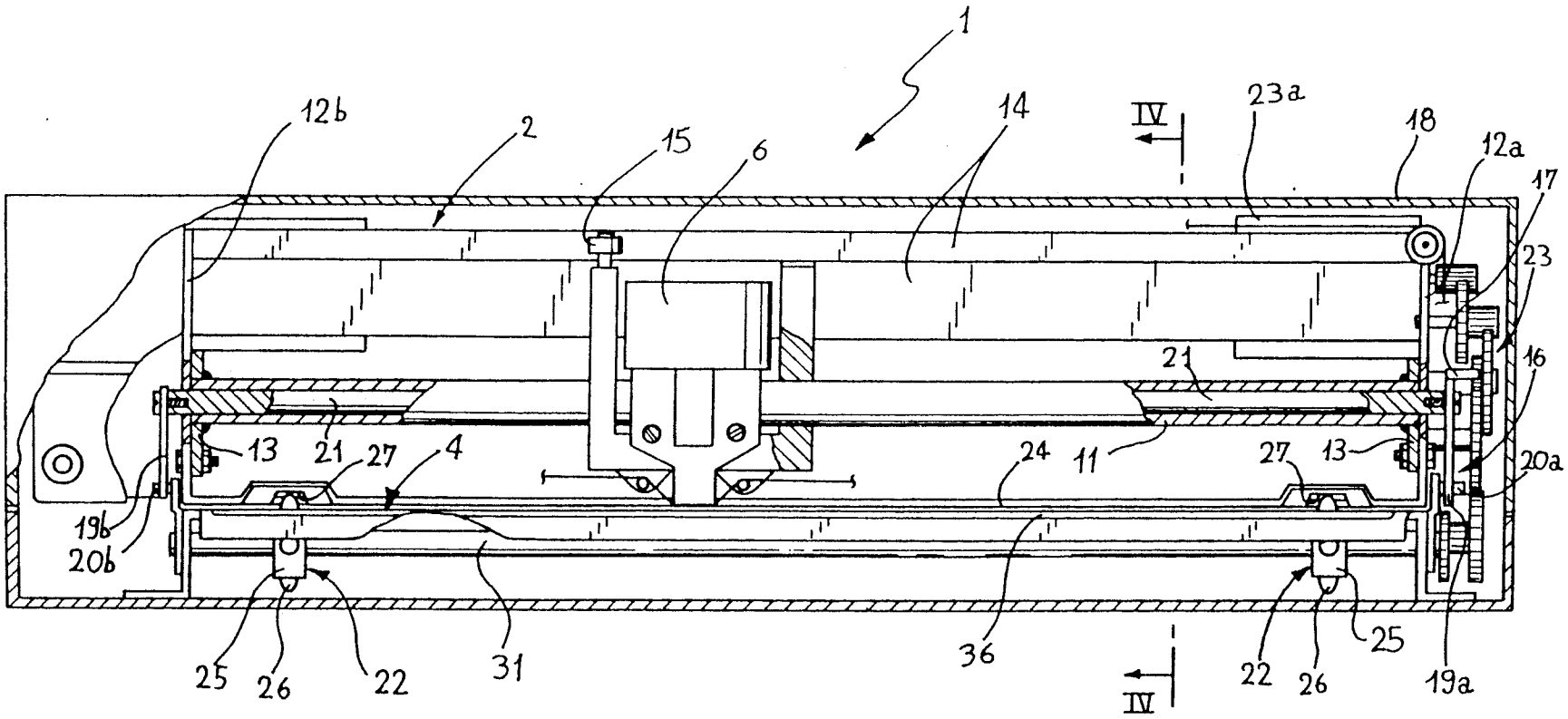
FIG. 1 is a partly sectional front view of the apparatus of the invention.
Figure 3:
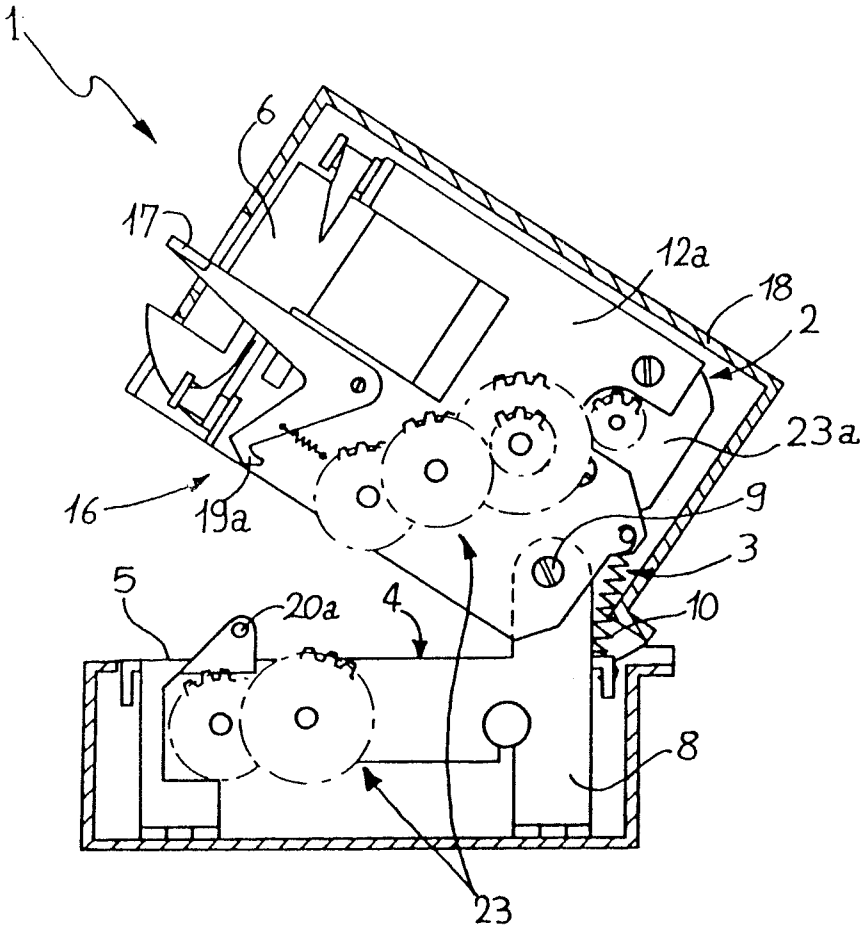
FIG. 3 represents the same view as shown in FIG. 2 but in a raised position for the introduction of a sheet thereinto.

Referring to the drawings, the portable printing apparatus in accordance with the invention is generally identified by reference numeral 1. It comprises a bearing structure 2 oscillatably engaged according to a substantially horizontal axis, through hinge means 3, to a plate-like body 4, in which a substantially flat write surface 5 is formed which is disposed underneath a print head 6 known per se. A sheet 7 to be printed, which may be a single sheet or consist of an endless form is adapted to rest on the write surface 5.

The hinge means 3 comprises a pair of brackets 8 integral with the plate-like body 4, articulation screws 9 and a spring 10 to keep the bearing structure 2 in a raised position.

The bearing structure 2 has a stiff rod 11, substantially having a hollow circular section and on which the print head 6 is slidably movable, and a pair of flattened side elements 12*a* and 12*b* between which the stiff rod 11 is comprised and to which it is engaged, at its ends, by means of extensions 13 integral with the rod itself and spaced apart from the axis thereof. The extensions 13 are in turn fastened to the flattened side elements 12*a* and 12*b*. In this manner the stiff rod 11 is prevented from rotating and the side elements 12*a* and 12*b* are secured exactly in a mutually parallel position.

Above the stiff rod 11 is provided a guide crosspiece 14. The crosspiece 14 is parallel to the stiff rod and attached to or engaged to the side elements 12*a* and 12*b*, along which the print head 6 is guided by guide means 15 such as sliding rollers.

Figure 2:
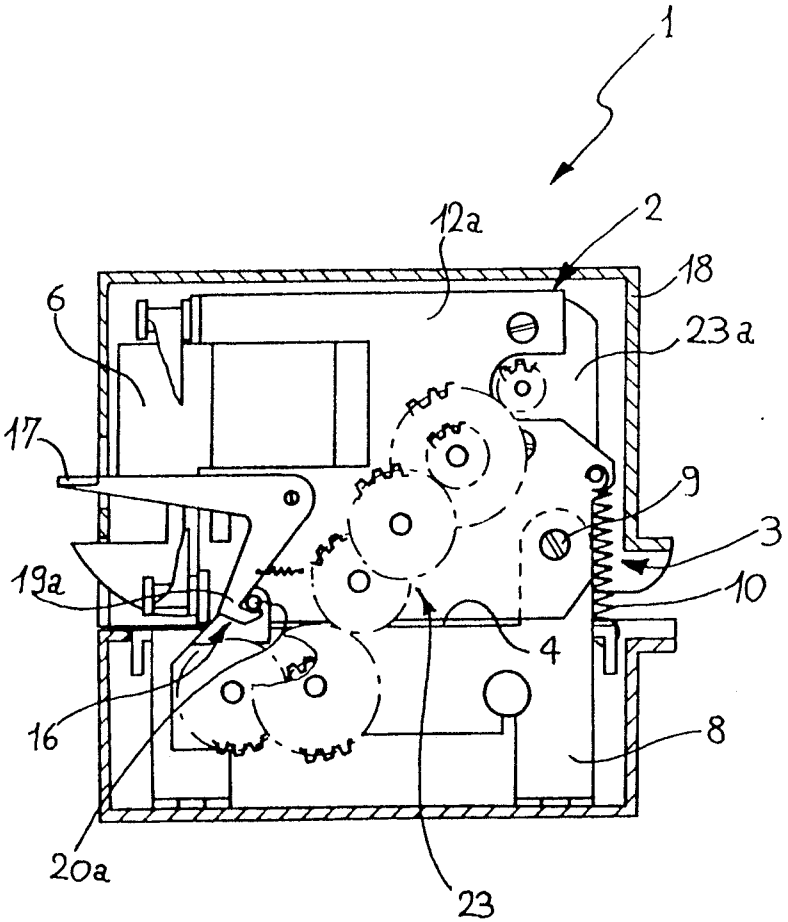
FIG. 2 is a side view of the apparatus in an operating position, showing the apparatus housing in section.

The bearing structure 2 can be clamped to the plate-like body 4 in an operating position in a rigid manner, as shown in FIG. 2, by closure means 16. The closure 16 is comprised of: a lever 17 disposed externally to one of the side elements 12*a*, 12*b*, operable by hand and protruding from a housing 18 which, divided into two portions, closes both the bearing structure 2 and the plate-like body 4; a first hooked element 19*a* integral with or connected to the lever 17 and a first restraining element 20*a*, engaged to the plate-like body 4 and designed to be hooked by the first hooked element 19*a*. The first hooked element 19*a* is rigidly connected through a stem 21 passing through the rigid rod 11, to a second hooked element 19*b*. The second hooked element is located externally to the side element 12*b* and in turn adapted to be hooked to a second restraining element 20*b* secured to the plate-like element 4 as well.

Apparatus 1 also comprises a dragging unit adapted to move the sheet 7 to be printed under the print head 6 and exhibiting dragging members 22 directly acting on the sheet 7 and originally disposed in the plate-like body 4 substantially underneath the write surface 5.

The dragging members 22 are moved by a gearing 23 comprised of toothed wheels disposed partly in the bearing structure 2 and partly in the plate-like body 4, in turn operated by an electric motor 23*a* being part of a drive unit not shown as known per se, located within the bearing structure 2.

The kinematic chain defined by gearing 23 is interrupted when the bearing structure 2 is raised and becomes automatically engaged when the bearing structure is lowered to take the operating position.

Connected to the lower part of the bearing structure 2 is an upper plate 24 substantially matching the shape of the write surface 5 and disposed above the latter so that the sheet 7 is between the write surface 5 and the plate 24 in the operating position.

Figure 4:
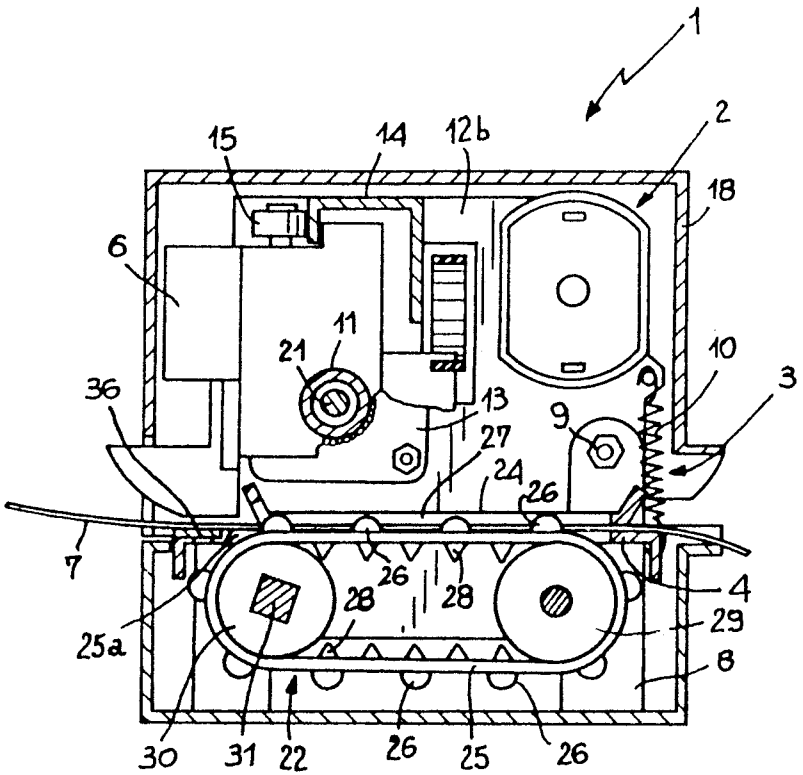
FIG. 4 is a sectional view of the apparatus taken along line IV—IV in FIG. 1 provided with one type of dragging members.

In one embodiment, shown in FIG. 4, the dragging members comprise a pair of rotating elements 25 of the so-called "sprocket type", cog belts for example, disposed spaced apart from each other in a position close to the side elements 12*a*, 12*b*. On the upper side, the rotating elements 25 project susbtantially flush with the write surface 5 through appropriate passageways 25*a* formed in the plate-like body 4. The rotating elements 25 are each provided with outer teeth 26 that partly pass through slits 27 formed in the plate 24 and adapted to engage into corresponding edge perforations in the sheet 7, as well as with inner teeth 28 for causing a drive roller 30 fitted on a square-section shaft 31 moved by the gearing 23 to drive an idler roller 29.

The plate 24 is preferably, close to at least one of its side edges, with a pair of slits 27 disposed in side by side relation, adapted to be selectively passed through at least partly by the outer teeth 26 if it is provided that the rotating toothed elements 25 and corresponding rollers 29 and 30 should be positioned spaced apart from each other or close to each other depending upon the width of the sheets 7 to be printed.

Figure 5:
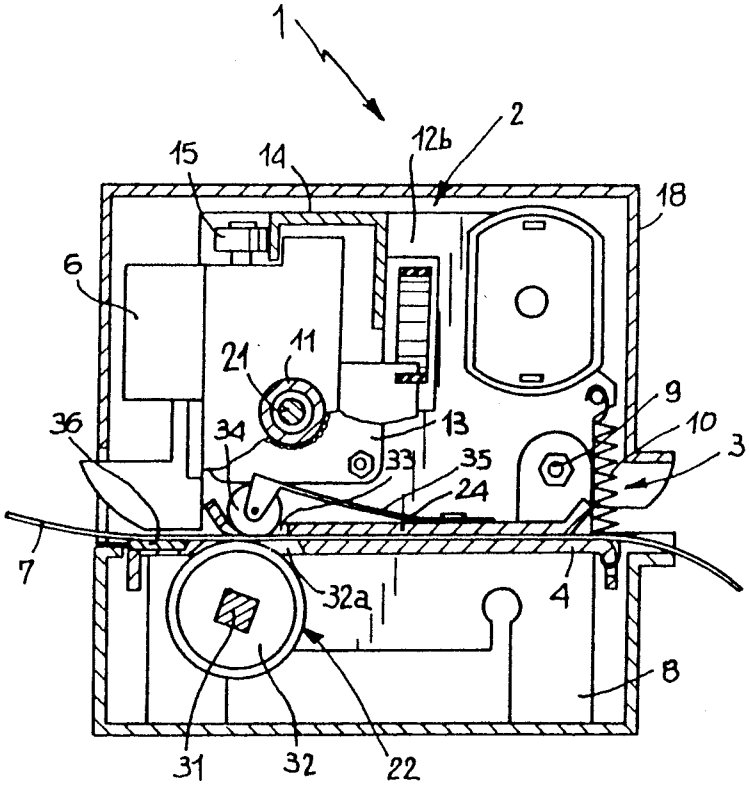
FIG. 5 is a sectional view of the apparatus taken along line IV—IV in FIG. 1 provided with a second type of dragging members.

In a second embodiment, shown in FIG. 5, the dragging members 22 are comprised of a number of friction rollers 32, suitably disposed spaced apart from the square-section shaft 31. The upper part of the friction rollers 32 substantially protrudes flush with the write surface 5 through suitable passageways 32*a*. According to this construction solution, the plate 24 has a number of apertures 33 in register with the friction rollers 32, which apertures are passed through by a number of friction counter-rollers 34 operating against the spring action of the friction rollers 32 and engaged to the plate 24 by means of flat springs 35.

Advantageously, in register with the write line of the print head 6 there is a strip 36 of elastomeric material, preferably ADIPRENE, engaged to the write surface 5.

OPERATION

Operation of the portable printing apparatus in accordance with the invention described above mainly as regards structure is as follows.

After operating the lever 17, overturning the bearing structure 2 is carried out. The bearing structure keeps a raised position by virtue of spring 10. With the bearing structure in this position, the user can easily put the paper consisting of a single sheet or an endless form, in place on the write surface 5. In fact, above all in the case of use of dragging members of the "sprocket" type, the visibility of the paper transport area and the access thereto make the correct feeding of the paper into the printer very easy.

Subsequently the bearing structure 2 is lowered to the operating position and the closure means 16 clamps the bearing structure 2 to the plate-like body 4 by snap fitting, thereby forming a very stiff single block.

The sheet 7 is thus located between the plate 24 and the write surface 5.

If the embodiment shown in FIG. 5 is used, the sheet is pressed against the friction rollers 32 by the pressing counter-rollers 34.

The invention attains the intended purposes and achieves important advantages.

The bearing structure 2 is very light-in-weight and stiff. Possible small geometrical unevenesses present in the plate-like body 4 are corrected by the clamping carried out through the closure means 16 between the plate-like body 4 itself and the bearing structure 2. It is therefore possible to achieve a high accuracy.

It is also to be pointed out that the particular arrangement of the dragging members enables the apparatus bulkiness to be further reduced.

Finally it will be recognized that the ADIPRENE strip 36 surprisingly allows the noise of the apparatus in operation to be greatly reduced, the lifetime of the print ribbon to be enhanced and a perfect writing to be achieved even when copies under the main sheet are provided.

In addition the strip 36 has a long lifetime even if, unlike the traditional rotating rollers, it is continuously stressed.

The particular embodiment shown is advantageous also in its most specific aspects.

Modifications and variations may be made, all of them falling within the scope of the inventive idea. In addition, all of the details may be replaced by technically equivalent elements.

In the pratical accomplishment of the invention the materials used, forms and sizes can be of any nature and magnitude in accordance with requirements.

What is claimed is:

1. A portable printing apparatus comprising:

a bearing structure having a first and a second flattened side element;

a stiff rod having first and second ends rigidly engaging said first and second side elements;

a print head slidably carried by the stiff rod;

a pair of brackets mounted on the bottom of the apparatus;

a plate-like body connected to said brackets and having a write surface located underneath said print head and adapted to accommodate a sheet to be printed;

dragging means for moving the sheet under said print head and having dragging members directly acting on said sheet, said dragging members being disposed in said plate-like body substantially below said write surface;

hinge means for oscillatingly selectively connecting the bearing structure to the plate-like body between a lowered position and a raised position, said raised position corresponding to an inoperative state of the printing apparatus and said lowered position corresponding to an operative state of the printing apparatus, and said hinge means having a substantially horizontal pivotal axis;

closure means for rigidly clamping the bearing structure to said plate-like body in the operating position, said closure means comprising at least a lever, two hooked elements connected to said lever, and a restraining element engageable with said hooked element; and a stem rigidly engaged to said hooked elements and passing through the inside of said stiff rod.

2. The apparatus as claimed in claim 1, wherein said bearing structure comprises at least an upper guide crosspiece engaged to said side elements guide said print head.

3. The apparatus as claimed in claim 1, wherein said dragging unit comprises a drive unit located in said bearing structure and a gearing to transmit the motion from said drive unit to said dragging members, said gearing being disposed partly in said bearing structure and partly in said plate-like body and being adapted to become automatically engaged when the bearing structure is lowered to its operating position.

4. The apparatus as claimed in claim 1, wherein said dragging members are comprised of a pair of rotating toothed elements located spaced apart from each other in a position close to said side elements and adapted to engage with corresponding edge perforations of the sheet, and wherein an upper plate is provided which is engaged at the lower part thereof to said bearing structure and substantially matches the shape of the write surface, said sheet being included between said upper plate and write surface in said operating position.

5. The apparatus as claimed in claim 4, wherein said upper plate exhibits, close to at least one of its side edges, at least a pair of slits substantially disposed in side-by-side relation and adapted to be selectively passed through as least partly by the corresponding rotating toothed element.

6. The apparatus as claimed in claim 1, wherein said dragging members comprise a number of friction rollers and wherein provision is made for:

an upper plate engaged at the lower part thereof to said bearing structure, substantially matching the shape of the write surface and having a number of apertures in register with said friction rollers, and a number of pressing counter-rollers engaged to said plate disposed in register with said apertures and acting against the spring action of said friction rollers, said sheet being inserted between said upper plate, pressing counter-rollers and write surface in said operating position.

7. The apparatus as claimed in claim 1, wherein a strip made of elastomeric material is provided in engagement with said write surface at the write line of the print head.

* * * * *